United States Patent [19]

Nasu

[11] Patent Number: 4,646,403

[45] Date of Patent: Mar. 3, 1987

[54] TRANSFER ROLL ASSEMBLY IN TEXTILE MACHINE

[75] Inventor: Nobuo Nasu, Fukuyama, Japan

[73] Assignee: Kabushiki Kaisha Kawakami Seisakusho, Hiroshima, Japan

[21] Appl. No.: 777,541

[22] Filed: Sep. 18, 1985

[30] Foreign Application Priority Data

Oct. 5, 1984 [JP] Japan ..... 59-209525

[51] Int. Cl.[4] ..... D06C 3/06

[52] U.S. Cl. ..... 26/100

[58] Field of Search ..... 26/100, 99

[56] References Cited

U.S. PATENT DOCUMENTS

| | | | |
|---|---|---|---|
| 417,264 | 12/1889 | Miller | 26/100 |
| 1,799,603 | 4/1931 | Peterson | 26/100 |
| 2,752,151 | 6/1956 | Levine | 26/100 X |
| 3,727,816 | 4/1973 | Meneo | 26/100 X |

FOREIGN PATENT DOCUMENTS

| | | | |
|---|---|---|---|
| 414375 | 5/1925 | Fed. Rep. of Germany | 26/100 |
| 82963 | 11/1919 | Switzerland | 26/100 |

*Primary Examiner*—Robert R. Mackey

[57] ABSTRACT

A transfer roll assembly for transferring a length of a textile web in a textile machine includes left and right sets of transfer plates mounted on and extending axially of a drive shaft for coming into frictional, surface contact with a textile web supplied by the textile machine, each set of transfer plates being arranged about the drive shaft so as to form a regular polygon when viewed in cross section, with each individual transfer plate forming one side of the regular polygon. Means are provided for forcibly moving the left and right sets of transfer plates axially away from each other while the plates are in contact with the textile web, whereby the web is subjected to a sufficiently large force for elongating the web in the transverse direction while the web is being transferred by the transfer plates. Also provided are means for adjusting the timing at which the left and right transfer plates separate from each other.

1 Claim, 16 Drawing Figures

TRANSFER ROLL ASSEMBLY IN TEXTILE MACHINE

BACKGROUND OF THE INVENTION

This invention relates to a transfer roll assembly in a textile machine such as a web laying machine or fulling machine.

A web laying machine includes a transfer roll mounted on the machine frame and generally comprising a cylinder of circular cross section having a sheet made of a material such as felt or rubber affixed to its outer circumferential surface. A textile product comprising a length of fabric web rolled up under tension or a length of fabric web exhibiting a high degree of stretchability generally will be greater in length and smaller in width than the originally specified length and width. Consequently, when the web of fabric is laid and spread out on a spreading table from the aforementioned transfer roll as the textile machine longitudinally traverses the spreading table, the fabric develops wrinkles or tends to shrink when left standing on the table after being laid even if optimum transfer conditions have been set.

In an effort to solve this problem, the specification of Japanese Utility Model Publication No. 59-21155 discloses an arrangement having a transfer roll, the outer circumferential surface of which is formed to include left-handed and right-handed helical threads which, when the transfer roll is rotated, advance in mutually opposing directions. A length of a textile product is supported on the transfer roller in an untensioned state and is extended transversely by the action of the threads while being transferred and laid on the spreading table. With this conventional arrangement, however, the surface contact between the helical threads of the transfer roll and the textile product is so small as to approach point contact, with the result that the textile product is not subjected to a sufficient force for stretching or extending it in the transverse direction. Since it is impossible to adjust this force, which is dependent upon such material properties as the transverse stretch of the textile product and the state thereof, the proposed arrangement has only limited applications.

SUMMARY OF THE INVENTION

An object of the present invention is to provide a transfer roll assembly in a textile machine such as a web laying machine wherein a sufficient force for transversely extending a length of a textile product in reliable fashion can be obtained, and wherein the force can be adjusted to conform to the material properties and condition of the textile.

According to the present invention, the foregoing object is attained by providing a transfer roll assembly in a textile machine, comprising a transversely extending drive shaft rotatably supported on the textile machine frame, a left set of transfer plates and a right set of transfer plates, each set arranged about the drive shaft in a regular polygonal configuration when viewed in cross section and extending axially of the drive shaft, each transfer plate having an engaging member secured thereto, retaining collars for mounting the left and right sets of transfer plates on the drive shaft in such a manner transfer plates are movable axially, rotatable in unison with the drive shaft and fixed against rotation relative to the drive shaft, a cammed cylinder rotatably supported on the drive shaft in coaxial relation therewith and having circumferentially extending cam means inclined with respect to the axial direction, the cam means being engaged by the engaging members of the transfer plates so that the engaging members are capable of moving circumferentially therealong, the cam means being adapted to reciprocatingly guide the engaging means of the left and right transfer plates members in opposite phase relation to each other while the transfer plates rotate in unison with the drive shaft, whereby axially opposing ones of the left and right transfer plates repeatedly separate from each other while transferring a length of textile web, and means for adjusting the rotational position of the the cammed cylinder relative to the drive shaft and for releasably locking the cammed cylinder to the machine frame after the cammed cylinder is set to a prescribed rotational position.

As set forth above, the transfer roll assembly of the present invention includes the left and right sets of transfer plates mounted on and extending axially of the drive shaft, each set arranged about the drive shaft so as to form a regular polygon when viewed in cross section, with each individual transfer plate forming one side of the regular polygon. Besides providing a large area of contact between the web of fabric and each transfer plate, the arrangement is such that the left and right sets of transfer plates are forcibly moved away from each other via the engaging members which engage with the cam provided on the cammed cylinder, whereby the web of fabric is subjected to a sufficiently large force for elongating the fabric in the transverse direction. Moreover, since the cammed cylinder is capable of being positionally adjusted by being rotated about its axis, the timing at which the left and right sets of transfer plates are moved away from each other can be changed, so that the effective stroke over which the left and right transfer plate sets are moved away from each other while they are supporting the fabric web can also be changed by the change in timing. Accordingly, the transverse stretching force acting upon the fabric web can be adjusted to conform to such material properties as the stretch of the fabric and to the state of the fabric, such as the degree of its tension when in rolled form. The transfer roll assembly of the present invention therefore can be applied to a wide variety of textiles to reliably provide a satisfactory transverse stretching force to the textiles.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Embodiments of a transfer roll assembly according to the present invention will now be described for an arrangement in which the transfer roll assembly is applied to a web laying machine as one example of a textile machine.

Figure 1:
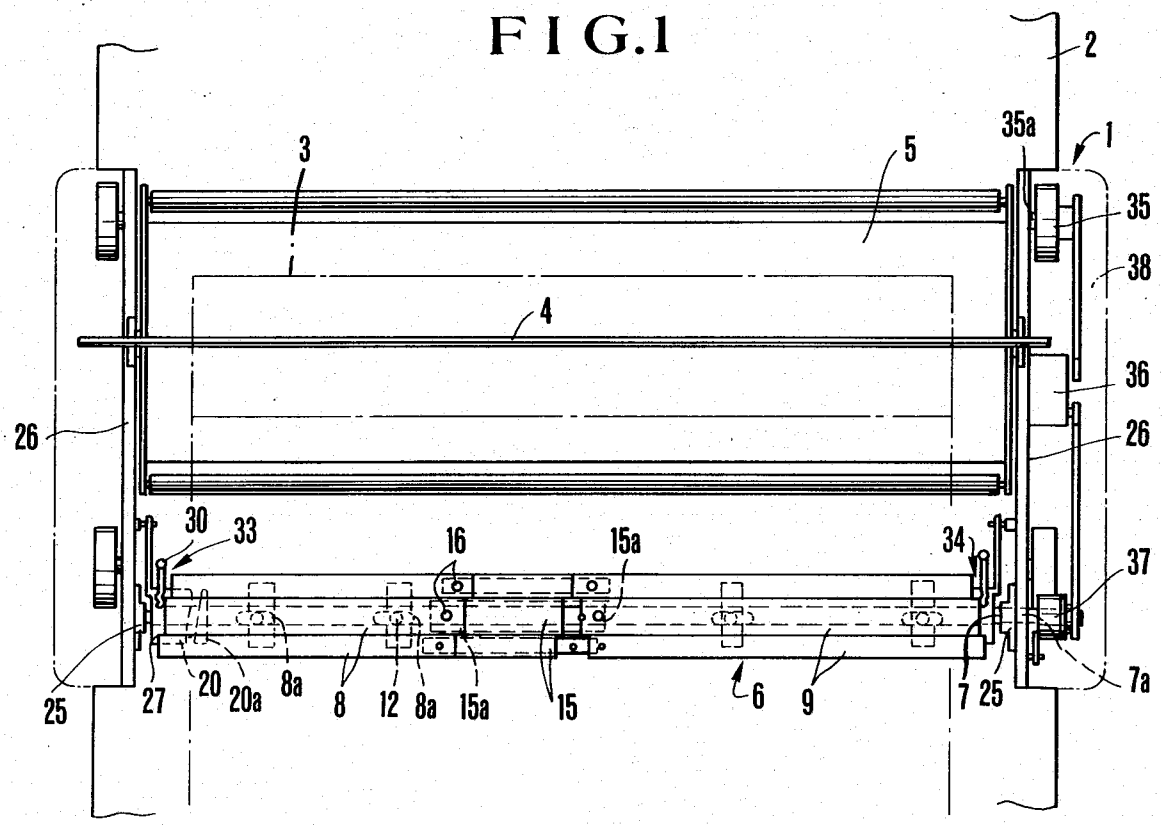
FIG. 1 is a schematic plan view illustrating a principal portion of a first embodiment of a transfer roll assembly according to the present invention.
Figure 2:
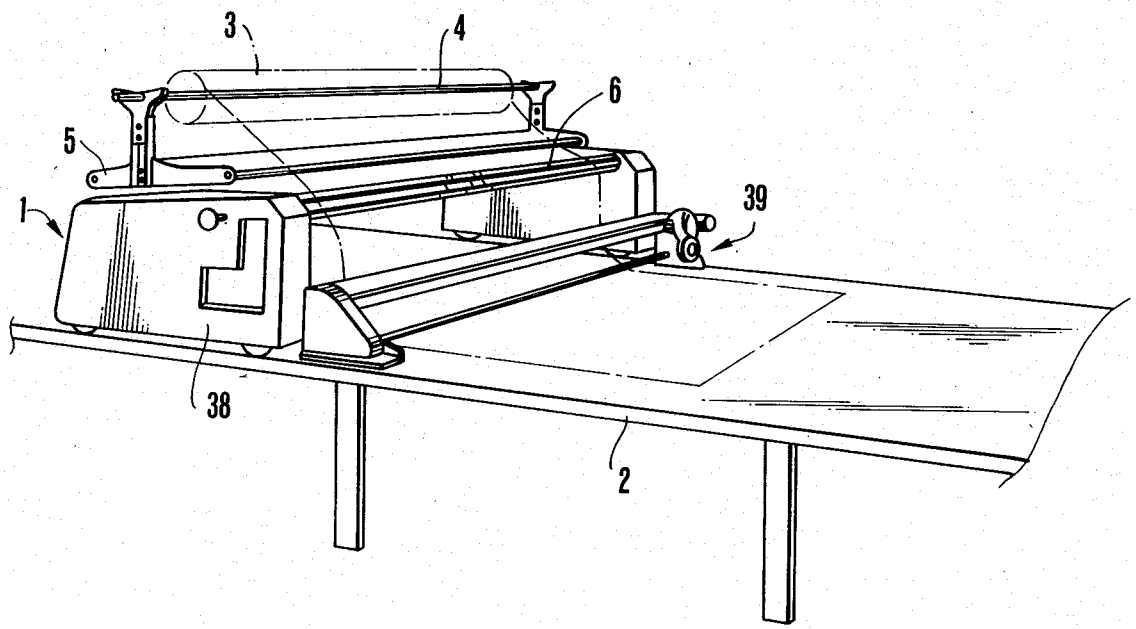
FIG. 2 is a schematic perspective view of the same.

With reference to FIGS. 1 and 2, a web laying machine body indicated generally by numeral 1 is adapted to travel longitudinally back and forth on a spreading table 2. A rolled-up length of a textile product 3, hereinafter referred to as a fabric web, is detachably supported on a support rod 4, which is in turn supported on a fabric web supply table 5 arranged on the rear portion of the machine body 1. Provided below and in front of the support rod 4 is a transfer roll assembly 6 embodying the present invention.

Figure 3:
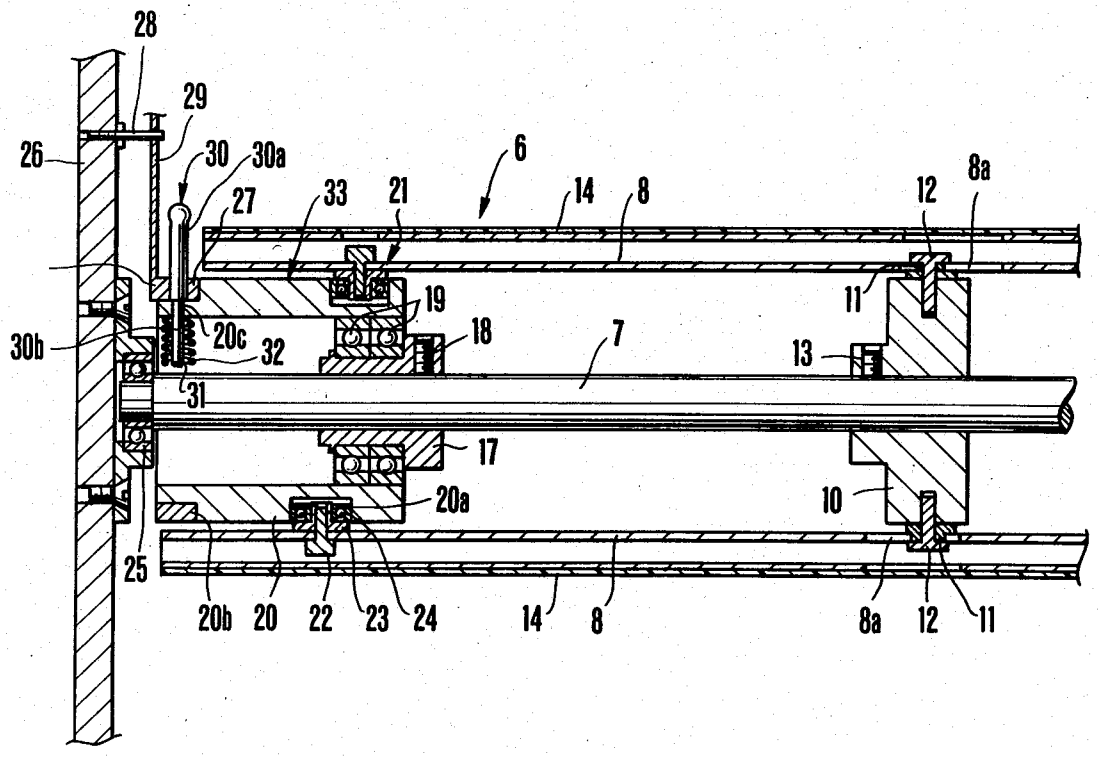
FIG. 3 is a side section illustrating one end portion of the transfer roll assembly.
Figure 4:
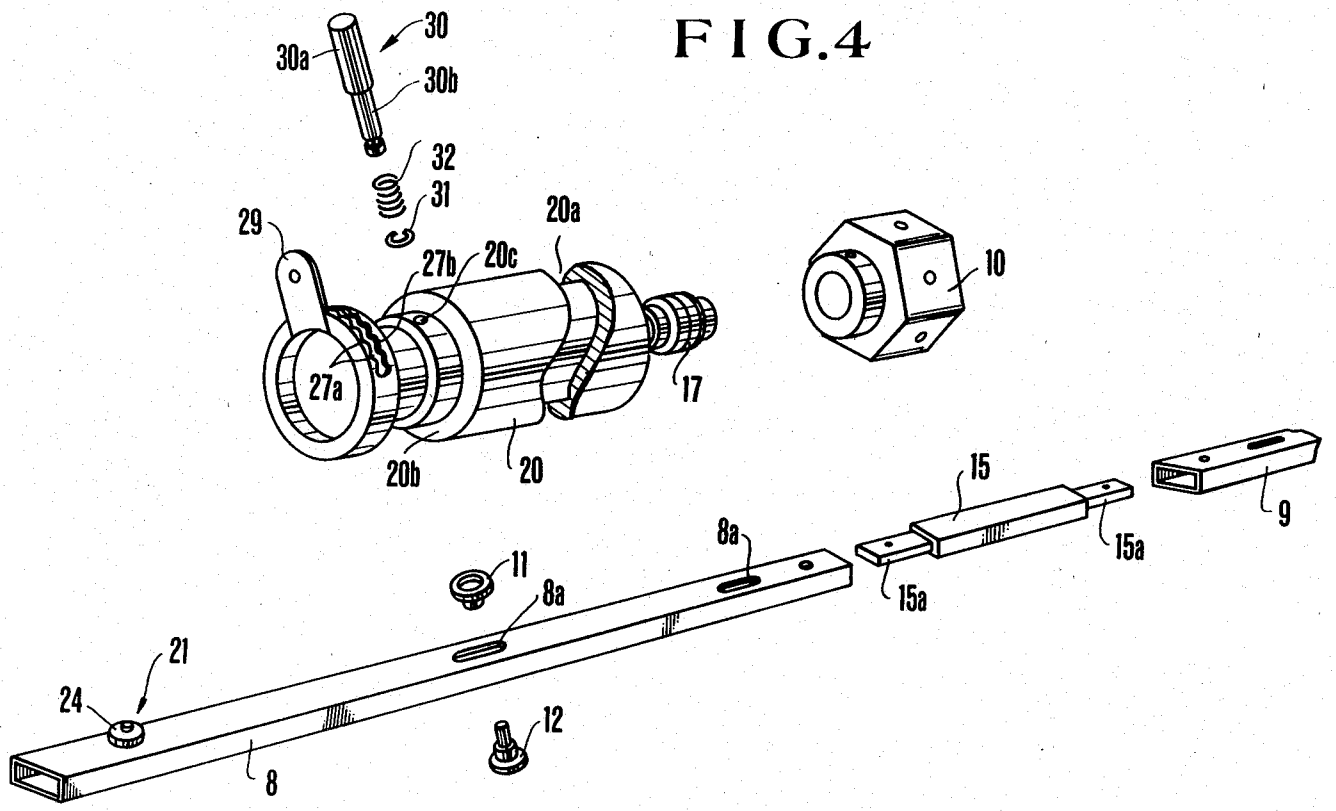
FIG. 4 is a perspective view illustrating a portion of the transfer roll assembly in exploded form.
Figure 5:
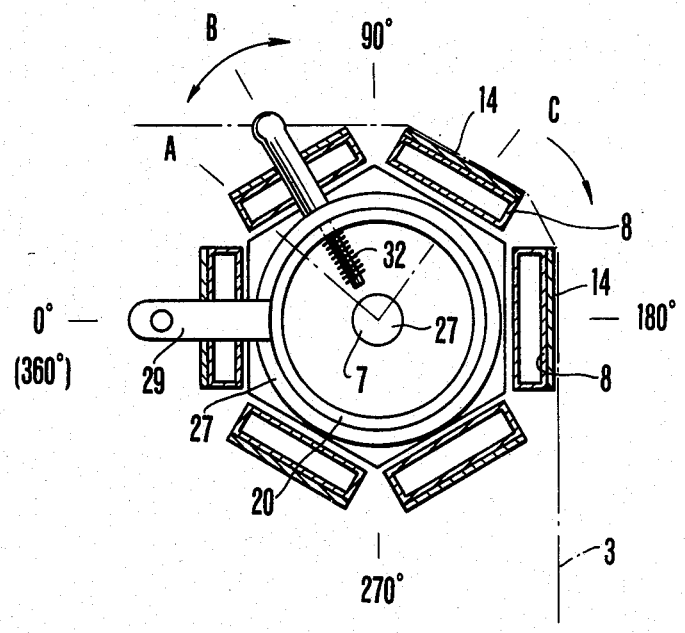
FIG. 5 is a transverse sectional view illustrating a portion of the transfer roll assembly.

As best shown in FIGS. 3 through 5, the transfer roll assembly 6 includes a transversely extending drive shaft 7 both ends whereof are supported via bearings 25 on a frame 26 constituting part of the machine body 1, a plurality of transfer plates 8 constituting a left-hand set and a plurality of transfer plates 9 constituting a right-hand set, each set of transfer plates being arranged about the drive shaft 7 so as to form a regular polygon (a regular hexagon in the illustrated embodiments) when seen in cross section, each individual transfer plate forming a side of the hexagon, and left and right regular hexagonal retaining collars 10 (only the left being shown) fixedly mounted on the drive shaft 7 and having each of its six faces attached to a corresponding one of the transfer plates 8, 9 in such a manner that the transfer plates 8, 9 are capable of moving axially of the drive shaft 7 and of rotating in unison therewith but not with respect thereto, as will be described in further detail hereinbelow.

As the transfer roll assembly 6 has left-right symmetry in terms of both structure and operation, the following description shall focus on only one half, i.e., the left half, of the transfer roll assembly 6 for the sake of simplicity.

As best shown in FIG. 4, each of the transfer plates 8 has the form of a hollow slab or prism of rectangular cross section. Each transfer plate 8 is formed to include a longitudinally extending oblong hole 8*a* in the side thereof faced toward the drive shaft 7. A roller 11 rollably fitted into the oblong hole 8*a* is attached by a setscrew 12 to a corresponding one of the six faces of the regular hexagonal retaining collar 10. The latter is fitted on the drive shaft 7 and secured thereto by a setscrew 12. A sheet 14 of a material such as felt, moquette, rubber or sponge is affixed to each transfer plate 8 on the side thereof facing away from the drive shaft 7.

Disposed between the left transfer plates 8 and right transfer plates 9 are an equal number of changeover plates 15 of the same shape as the transfer plates 8, 9. Each changeover plate 15 has insertion tabs 15*a*, 15*a* projecting longitudinally from its end faces and sized to fit comparatively loosely into the interior of the transfer plates on either side. One of the tabs 15*a* of each changeover plate 15 is inserted into the corresponding transfer plate 8 and fastened tightly to the transfer plate by a readily removable screw 16 which, when removed, makes it possible for the tab 15*a* to freely withdraw from and penetrate the interior of the transfer plate.

A bearing collar 17 is fitted on the drive shaft 7 near the left end portion thereof and is securely attached thereto by a setscrew 18. A cammed cylinder 20 has one end thereof fitted on and supported by the bearing collar 17 via a ball bearing 19 and lies coaxial with the drive shaft 7. A grooved cam 20*a* inclined with respect to the axial direction is formed on the outside of the cylinder 20 at the supported end thereof and extends fully around the circumference of the cylinder 20. Each of the transfer plates 8 is provided with an engaging member 21 on the face thereof directed inwardly toward the drive shaft 7. The engaging member 21 includes a retaining collar 23 fixedly secured to the transfer plate 8 by a set screw 22, and a ball bearing 24 fitted snugly on the retaining collar 23. The ball bearing 24 rollably engages with the grooved cam 20*a* and thus is capable of moving therealong circumferentially of the cylinder 20.

As mentioned earlier, the end of the drive shaft 7 is journalled on the frame 26 via bearing 25, the frame 26 serving as a mounting member. Formed on the outer periphery of the cammed cylinder 20 at the end face thereof facing the frame 26 is an annular cut-out portion 20*b* rotatably fitted into an adjusting ring 27. Projecting radially outwardly from the adjusting ring 27 is a mounting arm 29 fastened against rotation to the frame 26 by a ring fastener 28. A plurality of circumferentially extending pin holes 27*a* interconnected by a communicating groove 27*b*, the width whereof is smaller than the diameter of the pin holes 27*a*, are formed in the adjusting ring 27. A pin hole 20*c* of a diameter equivalent to the width of the communicating groove 27*b* is formed in the cut-out portion 20*b* of the cylinder 20. A locking pin 30 has a large diameter portion 30*a* and a small diameter portion 30*b* forming the tip of the pin. The locking pin 30 is inserted from the outside of the adjusting ring 27 in such a manner that the large diameter portion 30*a* fits into one of the pin holes 27*a* and the tip of the small diameter portion 30*b* fits into the pin hole 20*c* and penetrates the interior of the cylinder 20. A coil spring 32 is fitted onto the small diameter portion 30*b* penetrating the interior of the cylinder 20, and a snap ring 31 is snapped onto the tip of the small diameter portion 30*b* to embrace the coil spring 31 between the snap ring and the inner wall of the cylinder 20. By pulling the locking pin 30 radially outwardly against the force of the coil spring 31 to extract the large diameter portion 30*a* from the pin hole 27*a* while the tip of the pin 30 is retained inside the cylinder 20 by the snap ring 31, the cylinder 20 can be rotated about its axis (about the drive shaft 7) as the small diameter portion 30*b* of pin 30 moves through the communicating groove 27*b* of the immovable adjusting ring 27. The position of the grooved cam 20*a* of cylinder 20 can thus be adjusted without completely pulling out the locking pin 30. After the adjustment is made, the large diameter portion 30*a* of locking pin 30 is fit into another one of the pin holes 27*a*. The cylinder 20 can thus be held at the new position via the fixed adjusting ring 27. The cammed cylinder 20, the engaging member 21, the adjusting ring 27 and the locking pin 30 form a cam mechanism 33. An identical cam mechanism 34, having left-right symmetry with respect to the cam mechanism 33, is provided at the other or right-end portion of the transfer roll assembly 6.

The extreme right-end portion of the drive shaft 7 projects beyond the frame 26, this portion being indicated at numeral 7*a* in FIG. 1. A wheel 35 having a shaft 35*a* is rotatably supported on the machine body 1. Motive power obtained from the shaft 35*a* of wheel 35 is transmitted to the projecting portion 7*a* of drive shaft 7 via a speed change gear and a clutch 37, whereby the drive shaft 7 is rotated in operative association with the wheel 35.

In FIGS. 1 and 2, numeral 38 denotes a side cover of the web laying machine body 1, and numeral 39 designates a cutting device provided at the front end of the machine body 1.

In the operation of the above-described embodiment of the transfer roll assembly 6, the leading edge of the rolled fabric web 3 is placed upon the transfer roll assembly 6 and a press roll (not shown) provided above and at the rear of the transfer roll assembly 6 is pressed against the fabric web 3 as required, in which state the drive shaft 7 is driven into rotation. As the drive shaft 7 rotates, the transfer plates 8, 9 of the transfer roll assembly 6 rotate in unison with the drive shaft 7 since they are fixed against rotation with respect thereto, whereby the fabric web 3 placed on the transfer plates 8, 9 is fed in the forward direction, i.e., to the right in FIG. 2. At the same time, the transfer plates 8, 9 reciprocate axially of the transfer shaft 7 in opposite phase relation since the rollers 11 secured to the retaining collar 10 roll back and forth along the oblong holes 8*a* formed in the transfer plates and the engaging member 21 provided on each one of the transfer plates 8, 9 is in fitted engagement with the grooved cam 20*a* of cylinder 20 locked to the frame 26 via the adjusting ring 27. Consequently, in one full revolution of the drive shaft 7, corresponding ones of the left and right transfer plates 8, 9 move away from each other toward the left and right sides of the drive shaft 7 as their engaging members 21 are guided by the respective grooved cams 20*a* in opposite phase relation, thereby applying a transverse stretching or elongating force to the fabric web 3 by virtue of the frictional contact between the fabric web 3 and the sheet 14 affixed to the outwardly facing side of each transfer plate. As a result, wrinkles extending longitudinally of the fabric web are removed as the web is pulled transversely to the left and right by the separating left and right transfer plates 8, 9 while being laid on the spreading table 2. Moreover, if the fabric web 3 exhibits a high degree of transverse stretchability and therefore is of diminished width owing to having been rolled up under the application of longitudinally directed tension, the web is stretched transversely by the action of the transfer plates 8, 9 to make up for this reduction in width.

When the drive shaft 7, namely the transfer roll assembly 6, makes one full revolution, the transfer plates 8, 9 return to their initial positions. As the web laying machine body 1 travels along the spreading table 2, the fabric web 3 is laid upon the table 2 through an operation similar to that performed by ordinary web laying machines. When the fabric web is laid to a predetermined length, the cutting device 39 is actuated to sever the predetermined length of fabric from the web. The foregoing operations are then repeated.

Figure 7:
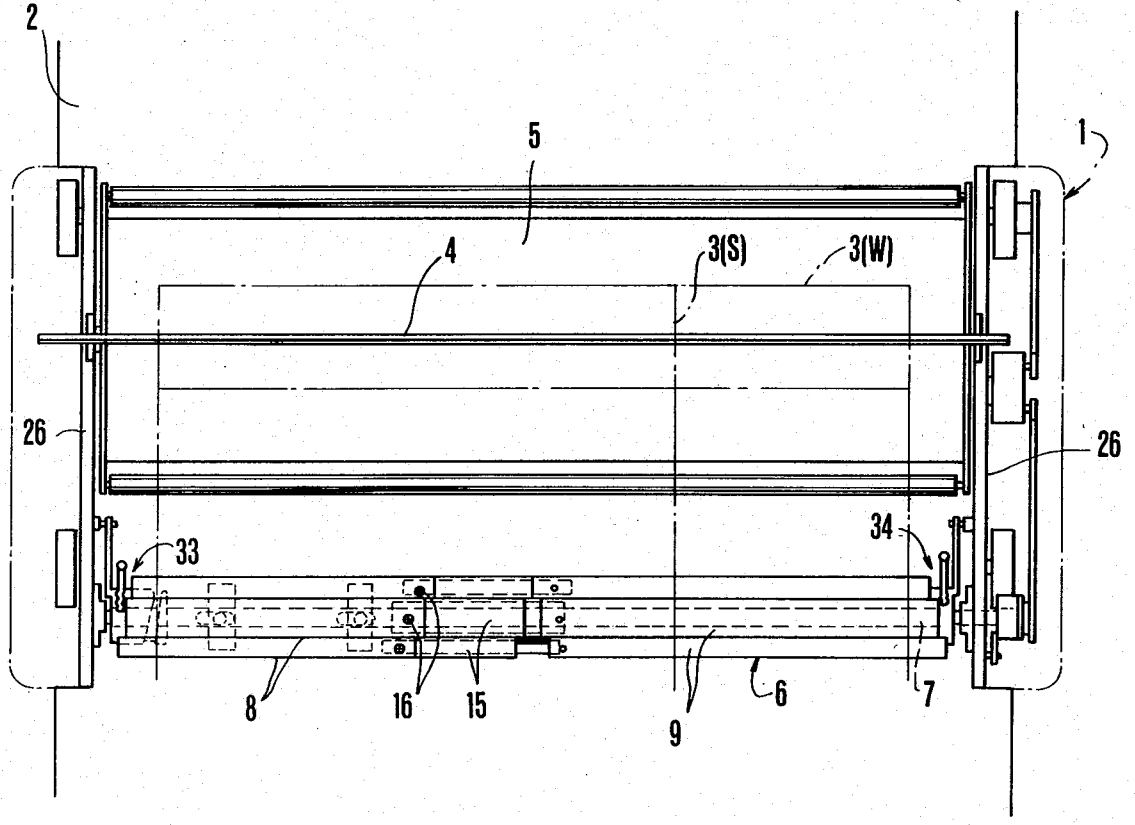
FIG. 7 is a plan view useful in describing the operation of the transfer roll assembly.

In performing a web laying operation, the side of the spreading table 2 opposite the side on which the motive force is transmitted to the drive shaft 7 is the operator's side. Customarily, the cut lengths of fabric web 3 are superimposed while their side edges are aligned with this side of the spreading table. As shown in FIG. 7, web fabrics generally are available in two widths, namely double (W) width and single (S) width. When the above-described transferring and transverse stretching operation is applied to a double width fabric web 3(W) with the changeover plates 15 being connected to corresponding ones of the left transfer plates 7 by the screws 16, as shown in FIG. 7, the corresponding left and right transfer plates 8, 9 separate from each other from a position corresponding to the center of the fabric web 3(W), as measured from the longitudinally extending sides thereof. As a result, the web is stretched transversely in a well-balanced manner. However, if a fabric web 3(S) of single width were to be stretched transversely without modifying the set-up, the position at which the left and right transfer plates 8, 9 part from each other would be off-centered transversely of the web, namely toward the side opposite the operator's side. This would result in an unevenly or irregularly stretched web. For a fabric web 3 of single width, therefore, the screws 16 are removed, each changeover plate 15 is detached from its corresponding left transfer plate 8, the tab 15*a* on the right side of each changeover plate 15 is fitted into the corresponding right transfer plate 9 and is secured thereto by the screw 16. This shifts the position at which the left and right transfer plates 8, 9 part toward the operator's side so that the transfer plates 8, 9 will move away from each other at a position corresponding to the center of the fabric web 3(S) as measured from the longitudinally extending sides thereof.

Depending upon their material properties, lengths of fabric web differ in terms of their degree of transverse extension. In addition, even fabric webs made of the same material will have different tensions when in rolled form. This makes it necessary to adjust the transverse stretching force applied to a fabric web when the web is laid. This adjustment is carried out in the manner described above, specifically by pulling back the locking pin 30, turning the cammed cylinder 20 about its axis relative to the fixed adjustment ring 27 to set the cylinder 20 in a new position, and reinserting the locking pin 30 to lock the cammed cylinder 20 to the frame 26 via the adjustment ring 27, thereby altering the timing at which left and right transfer plates 8, 9 will separate from each other as they rotate together with the drive shaft 7.

Figure 6:
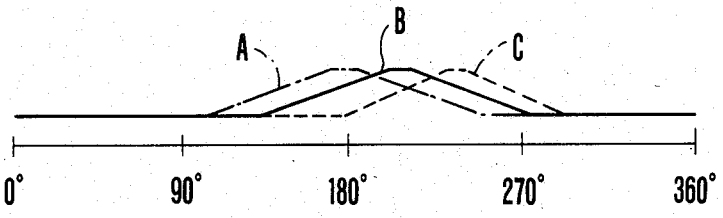
FIG. 6 is a view useful in describing the operation of a cam included in the transfer roll assembly of the present invention.

For a better understanding of the foregoing, reference is now had to FIGS. 5 and 6. As the fabric web 3 is transferred and laid, the web is in contact with the transfer roll assembly 6 over an angular range of about 90° to 180°. To maximize the transverse stretching force applied to the fabric web 3, the cammed cylinder 20 is set to position A so that corresponding left and right transfer plates 8, 9 will begin separating from each other at a comparatively early time, namely at the 90° position. If the cammed cylinder 20 is set to position B or C, on the other hand, the timing at which the transfer plates 8, 9 separate is delayed correspondingly, thereby shortening the effective separation stroke of the transfer plates 8, 9 and, hence, diminishing the transverse stretching force acting upon the fabric web 3. This is best shown in FIG. 6. When the cylinder 20 is set to position A, transfer plate separation begins early at about 90° and is maximized at about 180° when the web 3 is still in contact with the transfer roll assembly 6, thus allowing a large transverse stretching force to act upon the web 3. When the cylinder 20 is set to position C, however, transfer plate separation begins later at about 180° and maximum separation is attained when the web 3 is no longer in contact with the transfer roll assembly 6. As a result, the web 3 is subjected to a smaller transverse stretching force and for a shorter period of time. Accordingly, a proper transverse stretching force can be obtained by adjusting the angular position of the cammed cylinder 20 in dependence upon the type of material and the condition of the fabric web 3.

Figure 8:
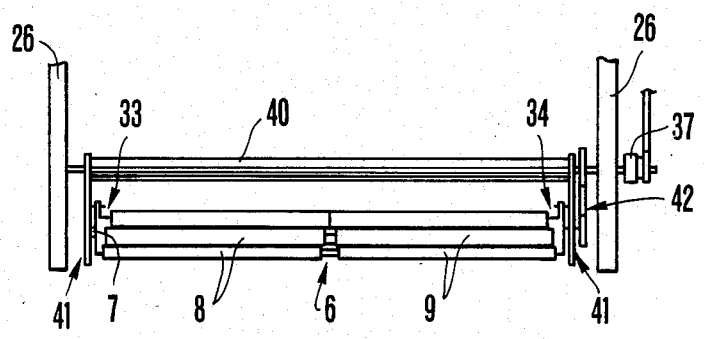
FIG. 8 is a schematic plan view illustrating a principal portion of a second embodiment of a transfer roll assembly according to the present invention.

A second embodiment of the present invention will now be described with reference to FIG. 8. Left and right arms 41 are connected by a transversely extending connecting pipe 40 and disposed inwardly of the frame 26. One end of each arm 41 is attached to the frame 26 in such a manner that the arms 41 are capable of being positionally adjusted about the axis of the connecting pipe 40. Provided between the other ends of the arms 41 are the transfer roll assembly 6 having the drive shaft 7 and the left and right transfer plates 8, 9, and the left and right cam mechanisms 33, 34, these being constructed as in the first embodiment described above. Motive power is transmitted to the drive shaft 7 from outside the frame 26 via a transmission mechanism 42 provided between the frame 26 and one of the arms 41. The drive shaft 7 is thus rotated in operative association with the wheel 37 provided on the web laying machine body.

Figure 11:
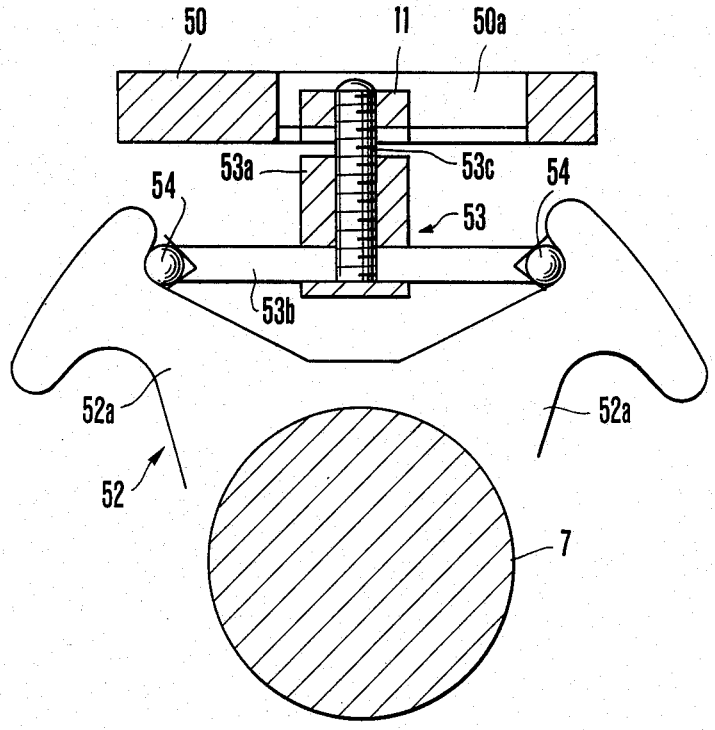
FIG. 11 is a sectional view useful in describing the mounting portion of a transfer plate constituting the transfer roll assembly.
Figure 9:
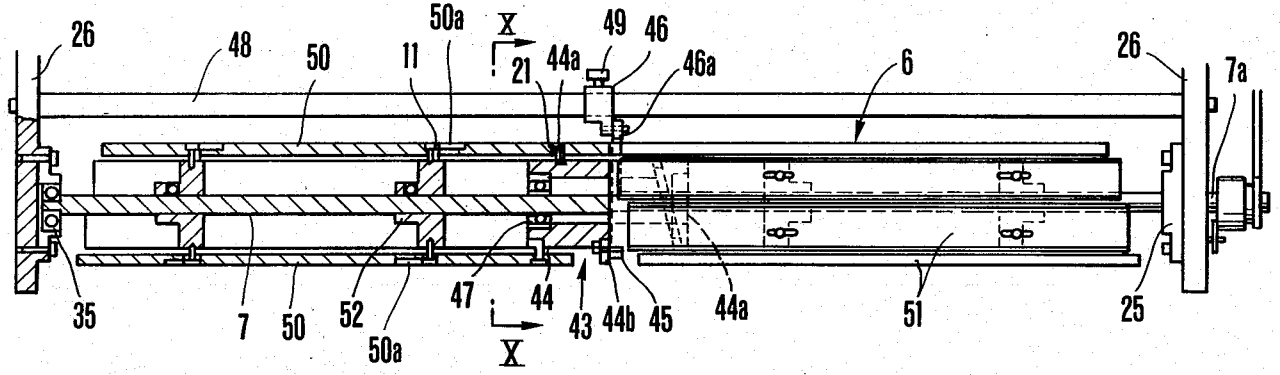
FIG. 9 is a plan view showing a principal portion of a third embodiment of a transfer roll assembly according to the present invention, the left half of the transfer roll assembly being shown in section.
Figure 10:
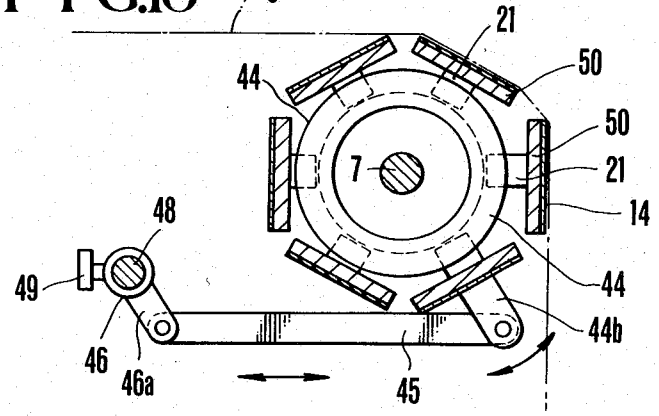
FIG. 10 is a sectional view taken along line X—X of FIG. 9.

A third embodiment of the present invention is illustrated in FIGS. 9, 10 and 11. In this embodiment, the drive shaft 7 is provided with a cam mechanism 43 at the central portion thereof in the axial direction. Specifically, the transfer roll assembly 6 of the third embodiment includes a single cammed cylinder 44 fitted onto and supported by the drive shaft 7 in coaxial relation therewith via left and right ball bearings 47, only the left of which is shown. Left and right grooved cams **44*a* having left-right symmetry and inclined with respect to the axial direction are formed on the outer circumferential surface of the cylinder 44 on its left and right end portions, respectively. The cylinder 44 is provided on its outer circumferential surface with a radially extending lever 44*b* located at the center of the cylinder 44 in the axial direction. The lever 44*b* is connected via a connecting link 45 to a lever 46*a* radially extending from the outer circumferential surface of an adjusting collar 46. The adjusting collar 46 is rotatably mounted on a transversely extending connecting rod 48 supported at its ends on the frame 26. The tip of a setscrew 49 screwed into the adjusting collar 46 is in pressured contact with the surface of the connecting rod 48. Loosening the setscrew 49 enables the adjusting collar 46 to be rotated relative to the connecting rod 48, and tightening the setscrew 49 secures the collar 46 to the connecting rod 48. Left and right sets of transfer plates 50, 51, respectively, are arranged on either side of the lever 44*b*. Provided on each of the transfer plates 50, 51 on the side thereof facing the drive shaft 7 is the engaging member 21. The engaging member 21 of each left transfer plate 50 engages with the left grooved cam 44*a*, and the engaging member of each right transfer plate 51 engages with the right grooved cam 44*a*. Rotating the adjusting collar 46 after loosening the set screw 49 turns the cylinder 44 via the lever 46*a*, connecting link 45 and lever 44*b* so that the angular position of the grooved cam 44*a* can be adjusted freely rather than in stages as in the first embodiment. After the grooved cam 44*a* is set to the desired position, the setscrew 49 is tightened to fix the adjusting collar 46 to the connecting rod 48, thereby fixing the cylinder 44 against rotation. With the present embodiment, therefore, the timing at which the left and right transfer plates 50, 51 separate from each other can be freely and finely adjusted and only the single cam mechanism 43** suffices, thereby facilitating the adjustment operation.

In this third embodiment of the invention, each of the transfer plates 50, 51 is of substantial thickness. As shown in FIG. 11, a retaining collar 52 is secured to the drive shaft 7 and has radially extending projections **52*a*. A holder 53 has a columnar body 53*a*, a holding rod 53*b* that projects from both sides of the columnar body 53*a*, and a central shaft 53*c*. The holding rod 53*b* is supported between mutually adjacent ones of the projections 52*a* via balls 54, and the roller 11 is rotatably attached to the shaft 53*c* but fixed against movement in the axial direction. The roller 11 is in rolling engagement with an oblong groove 50*a* provided in a corresponding one of the transfer plates 50**.

Figure 12:
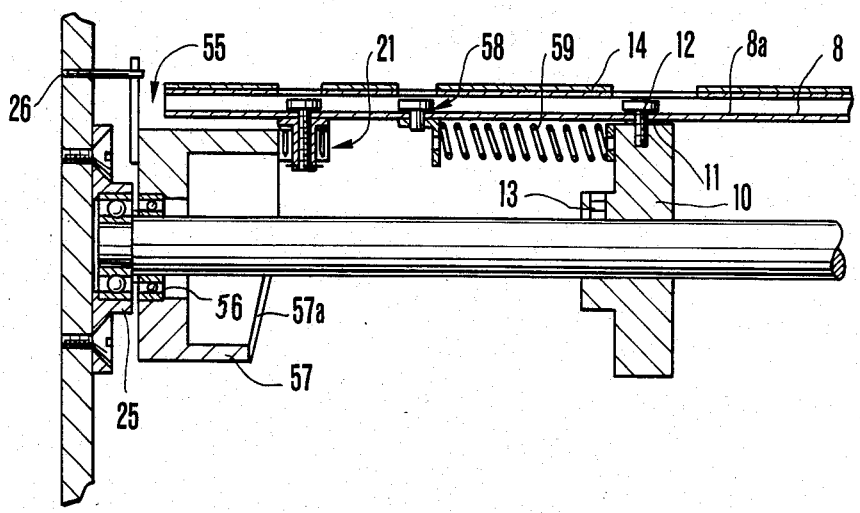
FIG. 12 is a side section illustrating one end portion of a fourth embodiment of a transfer roll assembly according to the present invention.

A fourth embodiment of the present invention is shown in FIG. 12 and includes a cam mechanism 55 having a cammed cylinder 57 fitted on the drive shaft 7 via a bearing 56 and capable of rotation but fixed against movement in the axial direction. The inner end face of the cylinder 57 is formed to include a cam **57*a* opposed by the engaging member 21 provided on each of the transfer plates 8. A spring 59 is compressed between the retaining collar 10 secured to the drive shaft 7 and a spring retainer 58 secured to the inner side of the transfer plate 8. The spring 59 acts through the transfer plate 8 to urge the engaging member 21 into pressured contact with the cam 57*a*. The cylinder 57 is attached to the frame 26** by suitable means so as to be positionally adjustable about its axis of rotation.

The cam mechanism 55 described above is associated with the left side of the transfer roll assembly 6. An identical cam mechanism having left-right symmetry with respect to the left cam mechanism 55 is also provided on the right side of the transfer roll assembly and operates in an identical manner.

In terms of structure and operation, the second, third and fourth embodiments of the invention are similar to the first embodiment except for the aspects described above. Reference characters in FIGS. 8 through 12 identical with those shown in FIGS. 1 through 5 designate like parts.

Figure 13:
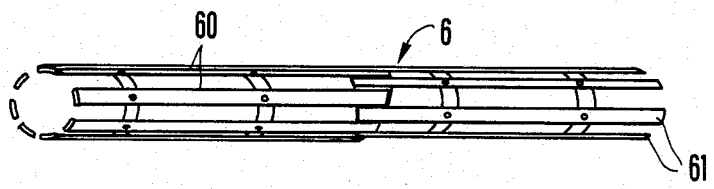
FIGS. 13 and 14 are schematic perspective views illustrating different modifications of the transfer roll assembly.
Figure 14:
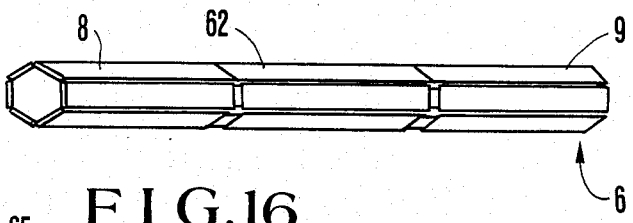
Figure 16:
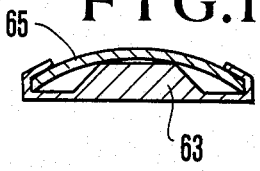
FIG. 16 is a transverse sectional view of a transfer plate constituting the transfer roll assembly of FIG. 15.
Figure 15:
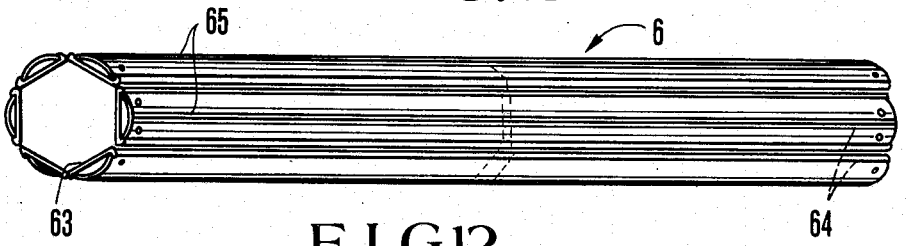
FIG. 15 is a schematic perspective view illustrating another modification of the transfer roll assembly.

It should be noted that the transfer plates constituting the transfer roll assembly of the present invention are not limited to the regular hexagonal arrangement, when seen in cross section, of the first embodiment. By way of example, as shown in FIG. 13, left and right sets of transfer plates 60, 61 can be arranged in a regular octagonal configuration when viewed in cross section, with the opposing end portions of corresponding plates 60, 61 being overlapped with the opposing end portions of other corresponding ones of the plates 60, 61 in staggered fashion in the circumferential direction. Further, as shown in FIG. 14, an arrangement can be adopted in which a stationary plate 62 is secured to the drive shaft (not shown in FIG. 14) at the central portion of the transfer roll assembly 6 between the left and right halves thereof, with the left and right transfer plates 8, 9 being arranged respectively on the left and right sides of the stationary plate 62 in such a manner as to be separable from each other. In yet another arrangement as shown in FIGS. 15 and 16, a tape-like strip of rubber 65 is provided on the outer face of each of corresponding ones of transfer plates 63, 64 so as to extend over the entire combined length of these transfer plates 63, 64. Only the left and right end portions of the rubber strip 65 are fixed to the left and right transfer plates 63, 64, respectively. Accordingly, the rubber strip 65 will stretch when the plates 63, 64 move away from each other and contract when the plates approach each other. Such an arrangement prevents a fabric web from falling into a space between the mutually opposing transfer plates 63, 64 when these plates are separated from each other.

Also, though not shown, a plurality of the transfer roll assemblies of the present invention can be provided in juxtaposition longitudinally of the web laying machine and driven by motors controlled by electronic control means.

Though the present invention has been described in relation to a web laying machine, the invention can be widely applied to textile machines that treat such textiles as lengths of woven and knitted goods. Such machines include fabric inspecting machines which inspect fabrics for flaws, rewinding machines and fulling machines for forcibly shrinking textiles by use of temperature and moisture.

As many apparently widely different embodiments of the present invention can be made without departing from the spirit and scope thereof, it is to be understood that the invention is not limited to the specific embodiments thereof except as defined in the appended claims.

What I claim is:

1. A transfer roll assembly for transferring a length of a textile web longitudinally in a textile machine having a machine frame, comprising:

a transversely extending drive shaft rotatably supported on the machine frame;

a plurality of first generally longitudinal rectilinear transfer plates each having an outer surface and an inner surface arranged about said drive shaft in a regular polygonal configuration when viewed in cross section and extending axially of said drive shaft along the left half thereof, each of said first transfer plates having a first engaging member secured thereto;

a plurality of second generally longitudinal rectilinear transfer plates each having an outer surface and an inner surface, the number whereof is equal to the number of said first transfer plates, arranged about said drive shaft in a regular polygonal configuration when viewed in cross section and extending axially of said drive shaft along the right half thereof, each of said second transfer plates having a second engaging member secured thereto;

a plurality of generally longitudinal rectilinear changeover plates, the number whereof is equal to the number of said first transfer plates, arranged about said drive shaft in a regular polygonal configuration when viewed in cross section, and extending axially of said drive shaft intermediate said first and second transfer plates; each of said changeover plates having a tab at each longitudinal end projecting adjacent the inner surfaces of the respective transfer plates at each said longitudinal end of said changeover plates; means for removably securing each of said tabs to each respective adjacent transfer plate; said transfer plates at one of said left and right halves being removably secured to the corresponding respective tabs;

each of said first transfer plates being axially in line with a corresponding one of said changeover plates and a corresponding one of said second transfer plates;

a first retaining collar for mounting said first transfer plates on said drive shaft in such a manner that said first transfer plates are movable axially, rotatable in unison with said drive shaft and fixed against rotation relative to said drive shaft;

a second retaining collar for mounting said second transfer plates on said driving shaft in such a manner that said second transfer plates are movable axially, rotatable in unison with said drive shaft and fixed against rotation relative to said drive shaft;

a cammed cylinder rotatably supported on said drive shaft in coaxial relation therewith and having circumferentially extending cam means inclined with respect to the axial direction, said cam means being engaged by the first and second engaging members of said first and second transfer plates so that said first and second engaging members are capable of moving circumferentially therealong, said cams being adapted to reciprocatingly guide said first and second engaging members in opposite phase relation to each other while said first and second transfer plates rotate in unison with said drive shaft, whereby axially opposing ones of said first and second transfer plates repeatedly separate from each other at a prescribed timing while transferring a length of textile web; and cammed cylinder adjusting means for adjusting the rotational position of said cammed cylinder relative to said drive shaft and for releasably locking said cammed cylinder to the machine frame after said cammed cylinder is set to a prescribed rotational position;

the prescribed timing at which axially opposing ones of said first and second transfer plates separate from each other being changed by adjusting the rotational position of said cammed cylinder by said cammed cylinder adjusting means.

* * * * *